US006220921B1

(12) United States Patent
Kim

(10) Patent No.: US 6,220,921 B1
(45) Date of Patent: Apr. 24, 2001

(54) MOVABLE FROG TOY

(75) Inventor: Jung-Gyu Kim, Pusan (KR)

(73) Assignee: Jamina Corporation, Pusan (KR)

( * ) Notice: Subject to any disclaimer, the term of this patent is extended or adjusted under 35 U.S.C. 154(b) by 0 days.

(21) Appl. No.: 09/413,248

(22) Filed: Oct. 7, 1999

(30) Foreign Application Priority Data

Apr. 16, 1999 (KR) ..... 99-6281

(51) Int. Cl.[7] ..... A63H 31/00

(52) U.S. Cl. ..... 446/308; 40/411

(58) Field of Search ..... 496/268, 158, 496/289, 337, 338, 340, 356, 376, 391, 395, 397, 308; 40/411, 415

(56) References Cited

U.S. PATENT DOCUMENTS

| | | | | |
|---|---|---|---|---|
| 1,486,101 | * | 3/1924 | Megorden | 446/320 |
| 1,782,477 | * | 11/1930 | Price | 446/356 |
| 2,556,304 | * | 6/1951 | Velkas et al. | 446/320 |
| 4,411,099 | | 10/1983 | Cancel . | |
| 4,674,223 | * | 6/1987 | Pearce | 446/353 |
| 4,802,880 | | 2/1989 | Shaw . | |
| 5,040,319 | | 8/1991 | Wang . | |

* cited by examiner

*Primary Examiner*—Sam Rimell

(57) ABSTRACT

A movable frog toy includes a body, a mouth, a movable tongue, and front and rear legs. A sound generator is provided for simulating audible sounds of a real frog. A drive motor and transmission provide power and movement to the parts of the frog to simulate the realistic movements of a frog. The drive motor may be an electric motor. A plurality of gear groups coupled thereto are selectively driven to impart the realistic motion to the respective parts of the frog.

4 Claims, 9 Drawing Sheets

MOVABLE FROG TOY

BACKGROUND OF THE INVENTION

1. Field of the Invention

The present invention relates to a toy featuring animal characters, and more particularly to, a movable frog toy which can execute the same motions as real frogs.

2. Description of the Related Art

In general, most toys featuring animal characters are puppies and cats which can perform various motions and make sounds such as walking, wagging tails, crying, or the like. The conventional toys have satisfactorily given some amusement and pleasure to children.

However, as the conventional toys have been extant for a long time without particular variety, children are fed up with the toys. Therefore, a new toy which features new animal characters is needed.

Accordingly, some of attempts have been made in the prior art to design a movable or audible toy featuring a frog character as shown in U.S. Pat. Nos. 5,040,319, 4,802,880 and 4,441,099, However, these frog toys can imitate only the jumping motion of the frog, but cannot perform detailed motions, for example, motion to extend a lingua for catching food, or motion to vibrate the uvula when crying. These frog toys didn't give any feeling of familiarity or wonderfulness to the children.

SUMMARY OF THE INVENTION

In view of the foregoing, it is accordingly, an object of the present invention to provide a movable frog toy which overcomes the disadvantages of the prior art.

It is also an object of the present invention to provide a movable frog toy which performs various and individual motions of the frog, i.e., the same motions as a living, real frog such as motion to extend the lingua for catching food, or motion to vibrate the uvula when crying, thereby providing familiarity and curiosity to children.

It is a further object of the present invention to provide a movable frog toy which is differentiated from the conventional frog toys and has excellent commodity competitiveness.

BRIEF DESCRIPTION OF THE DRAWINGS

Understanding that these drawings depict only typical embodiments of the invention and are, therefore, not to be considered limiting of its scope, the invention will be described with additional specificity and detail through use of the accompanying drawings in which.

DETAILED DESCRIPTION OF THE PREFERRED EMBODIMENTS

Figure 1:
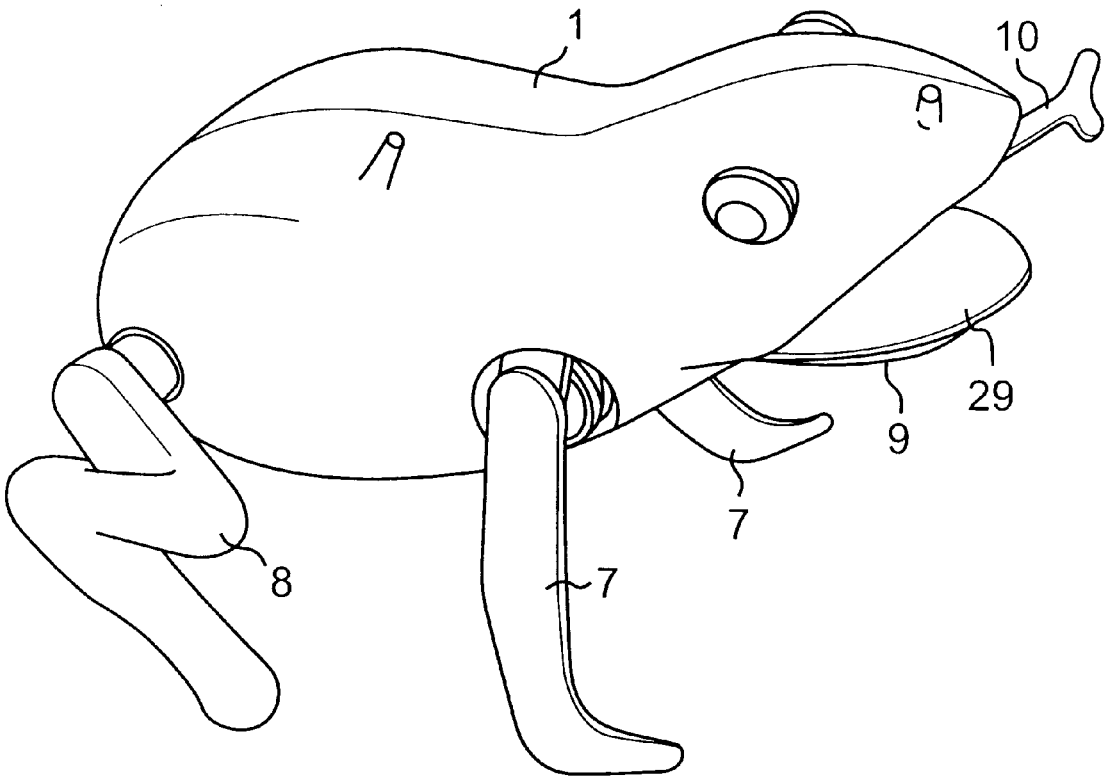
FIG. 1 is a perspective view of the frog toy of the present invention.
Figure 2A:
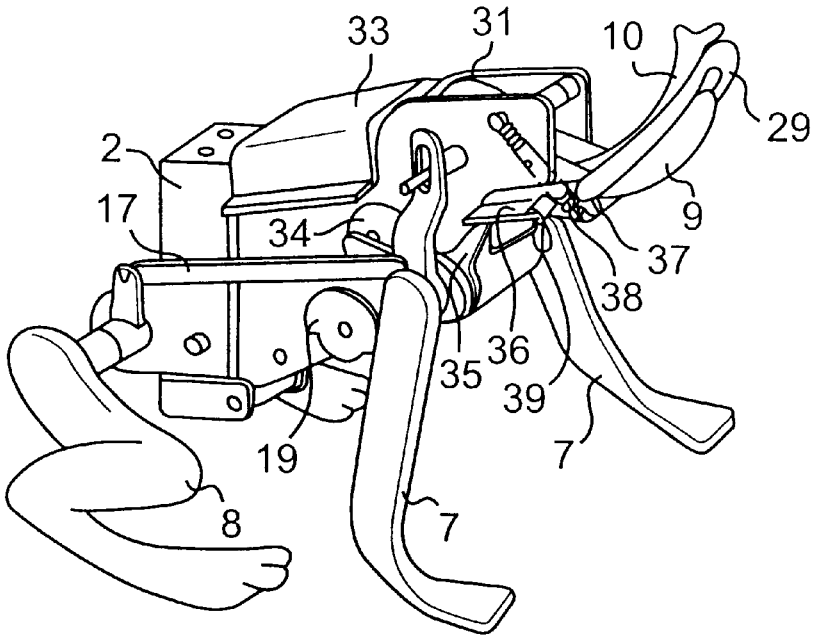
FIGS. 2*a* and 2*b* are side elevation views illustrating components of the toy of FIG. 1.
Figure 2B:
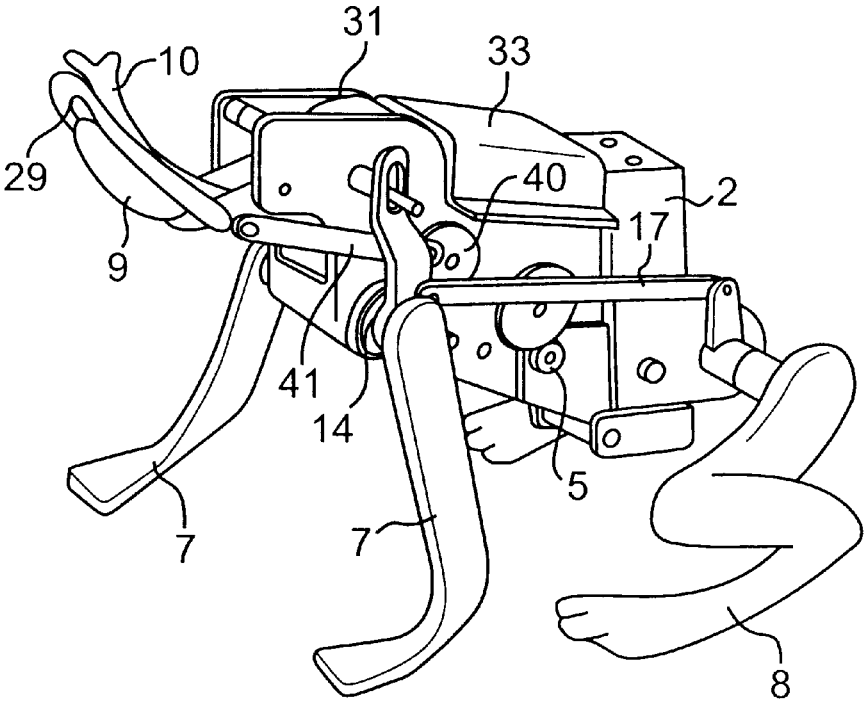
Figure 3:
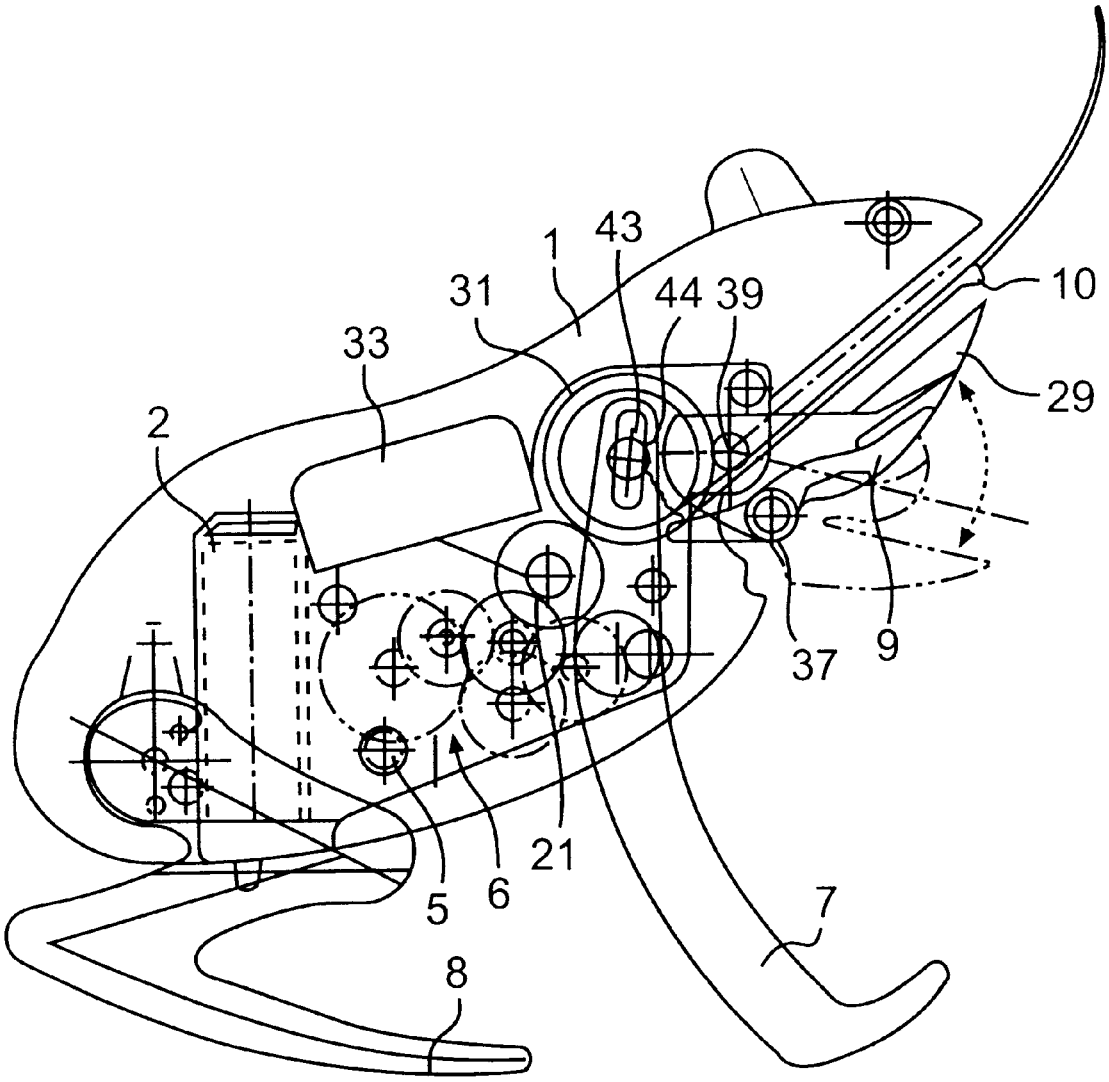
FIG. 3 is a view illustrating the construction of the frog toy of the present invention.
Figure 4:
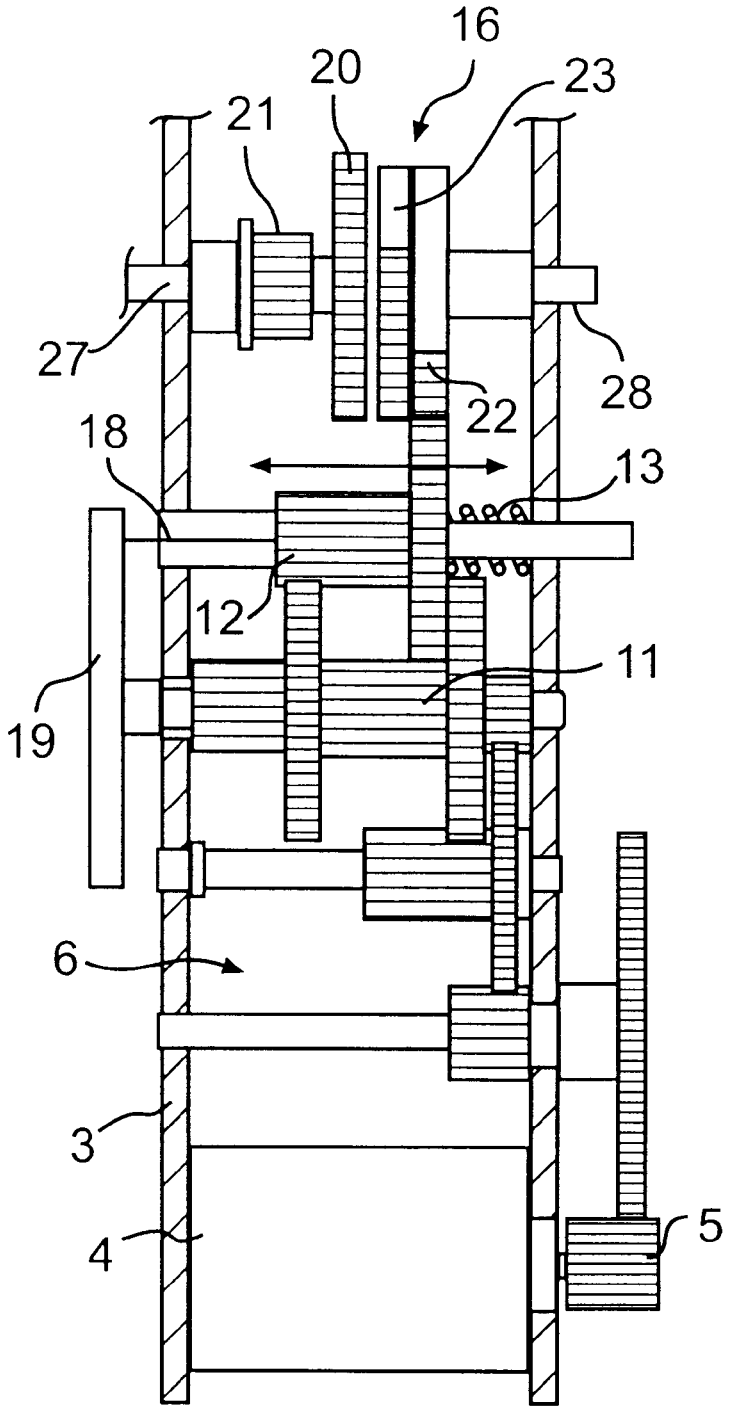
FIG. 4 is a view illustrating the construction of a gear group of the present invention.
Figure 5:
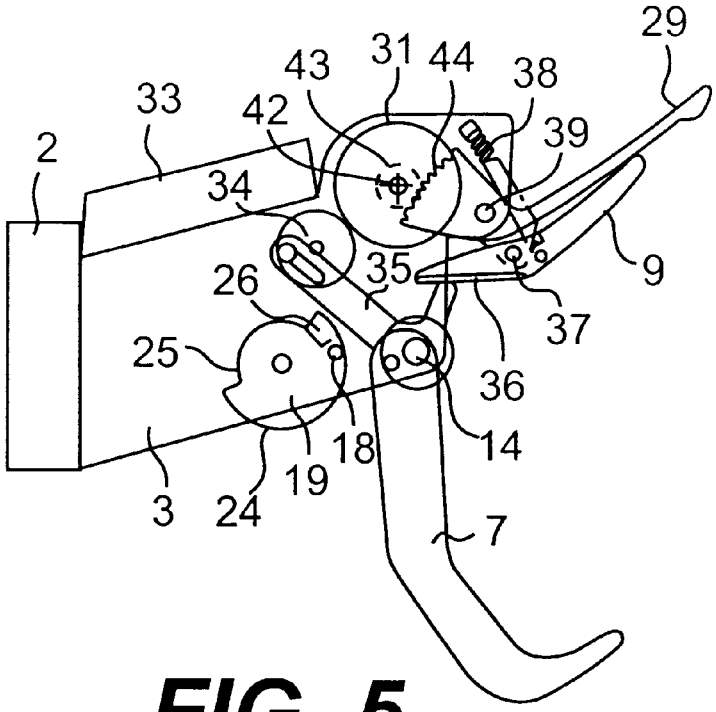
FIG. 5 is a partially cutaway view illustrating preferred primary components of the present invention.
Figure 6:
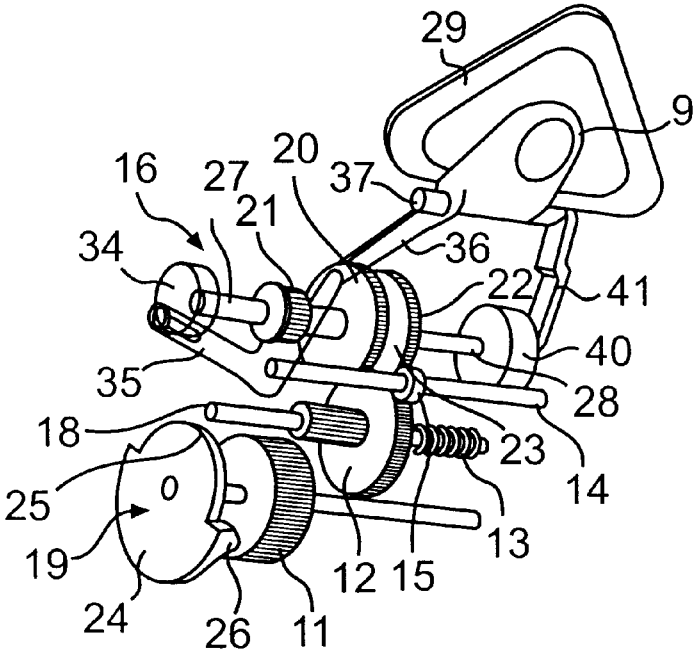
FIG. 6 is a partial perspective view of FIG. 5.

Referring now to the drawings, wherein like reference characters designate corresponding parts throughout several views.

FIG. 1 is a perspective view of outward appearance of the frog toy of the present invention.

Referring to FIGS. 1 to 6, the reference numeral 1 indicates a body of the frog-shaped toy according to the present invention. In the body 1, a battery box 2 and a gear box 3 are mounted. A plurality of transmission gear groups 6 are operatively connected to a driving gear 5 of a motor 4 in the gear box 3 such that front legs 7 and rear legs 8 are movable. The frog-shaped toy comprises an operation portion having the battery box 2 and the gear box 3 to operate the legs and sound production portion for producing sound with movement of a uvula 9 and lingua 10. An operation gear 11 is operatively connected to the transmission gear group 6. The operation gear 11 is geared to a clutch gear 12 which is elastically supported at an end portion thereof by a spring 13. The clutch gear 12 is operatively connected to an electric drive gear 15 of a crank shaft 14 and one gear of gears of operation gear group 16. The front legs 7 are eccentrically connected to the crank shaft 14 to which the electric drive gear 15 is mounted. The rear legs 8 are connected with the front legs 7 by a lever 17 such that the rear legs 8 are moved with the movement of the front legs 7. It is well know in the prior art that the operation gear 11 operatively connected to the transmission gear groups 6 which are operatively connected to the motor 4 are geared to the electric gear 15 of the crank shaft 14, and the front legs 7 and the rear legs 8 are moved at the same time.

A primary feature of the present invention is that the clutch gear 12 is selectively geared to one gear of the gears of the operation gear group 16 so as to simultaneously move the front legs 7 and the rear legs 8 and to repeatedly tremble the uvula 9 and extend the lingua 10 and retract it into the mouth of the frog. The construction of the present invention is described in detail as follows.

The operation gear 11 which is operatively connected to the transmission gear group 6 of the motor 4 is geared with the clutch gear 12 which is elastically supported by the spring 13 at the end thereof. The clutch gear 12 connected with the spring 13 has an integral rod 18 at the other end thereof. The integral rod 18 of the clutch gear 12 is contacted to a clutch operating cam 19 mounted at an end portion of the operation gear 11.

The clutch gear 12 is moved in three steps by the clutch operating cam 19 contacting with the integral rod 18 of the end of the clutch gear 12 such that the clutch gear 12 is operatively connected to the gears for moving the front legs 7 and the rear legs 8 and for producing sound.

Figure 7A:
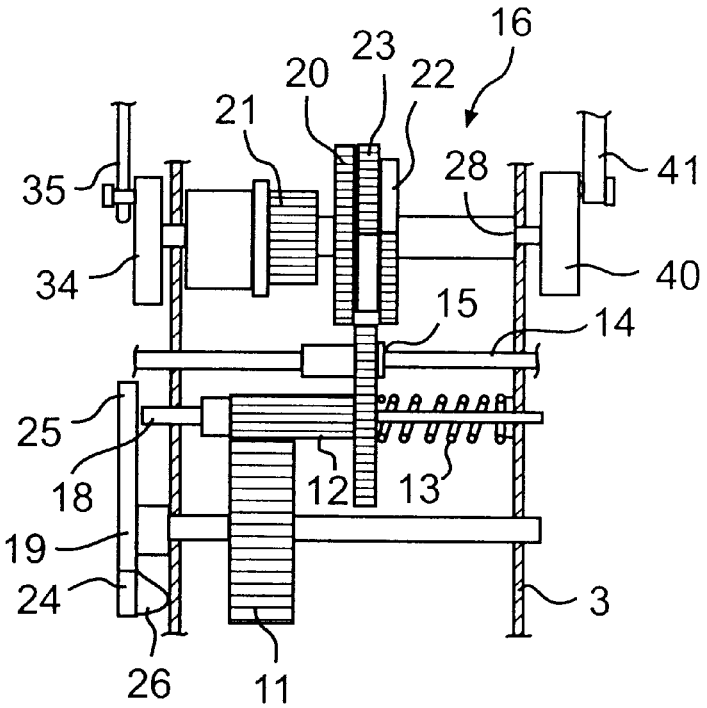
FIGS. 7*a*, 7*b*, and 7*c* are views illustrating an operative state of operating parts of the present invention.
Figure 7B:
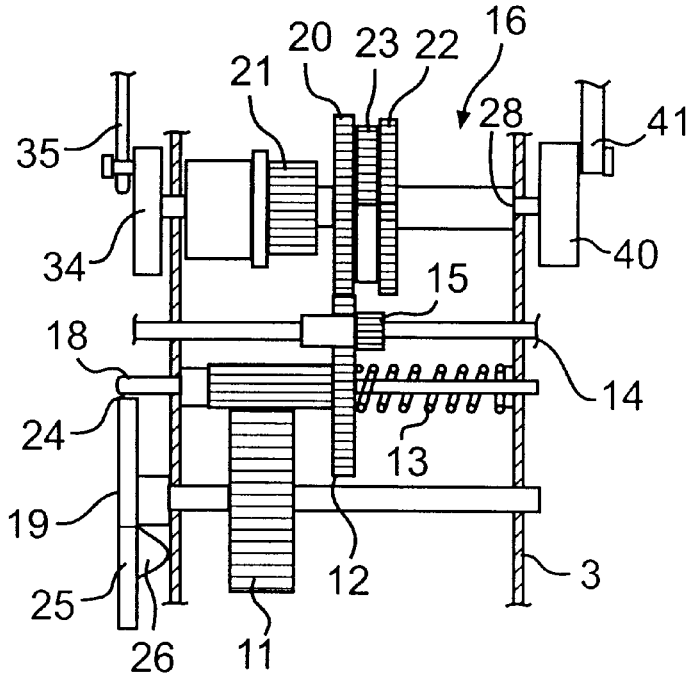
Figure 7C:
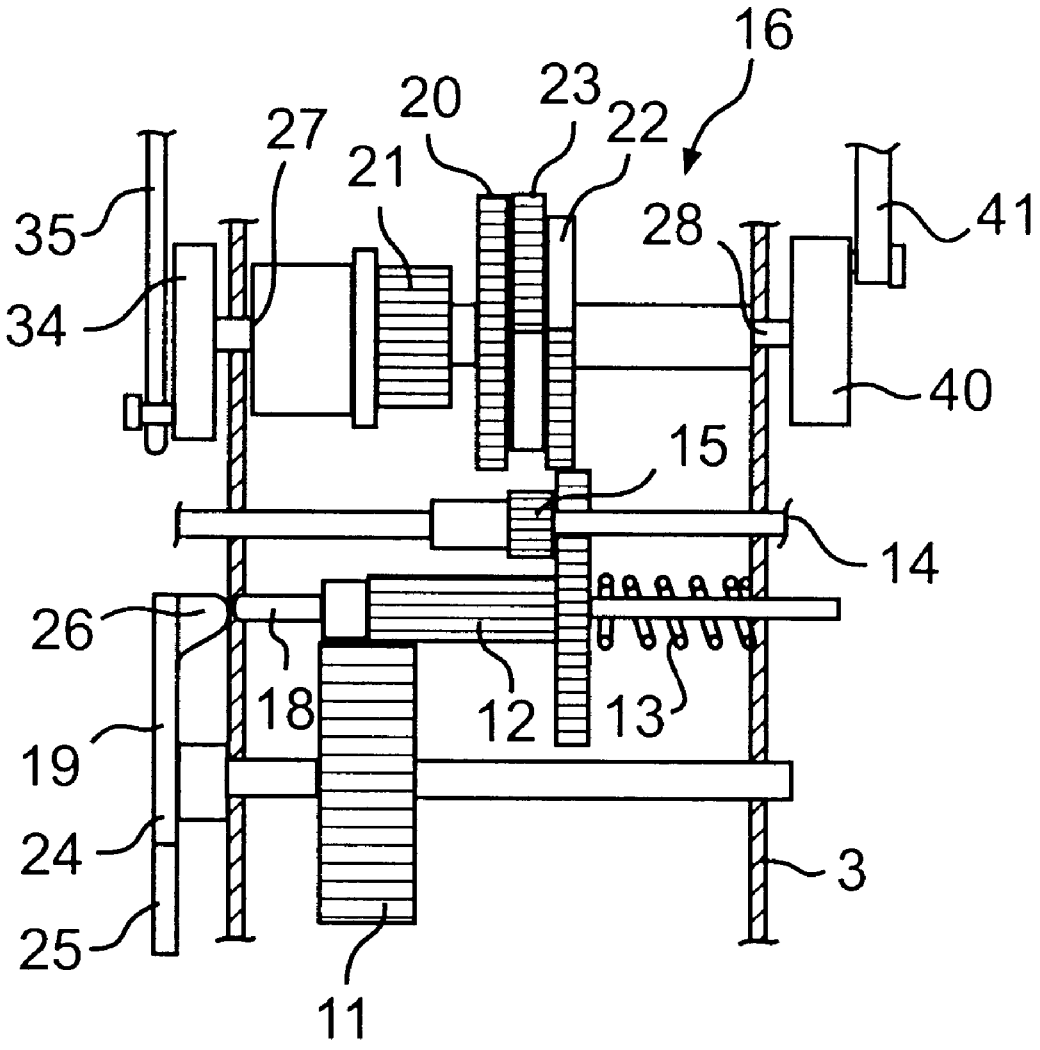
Figure 8A:
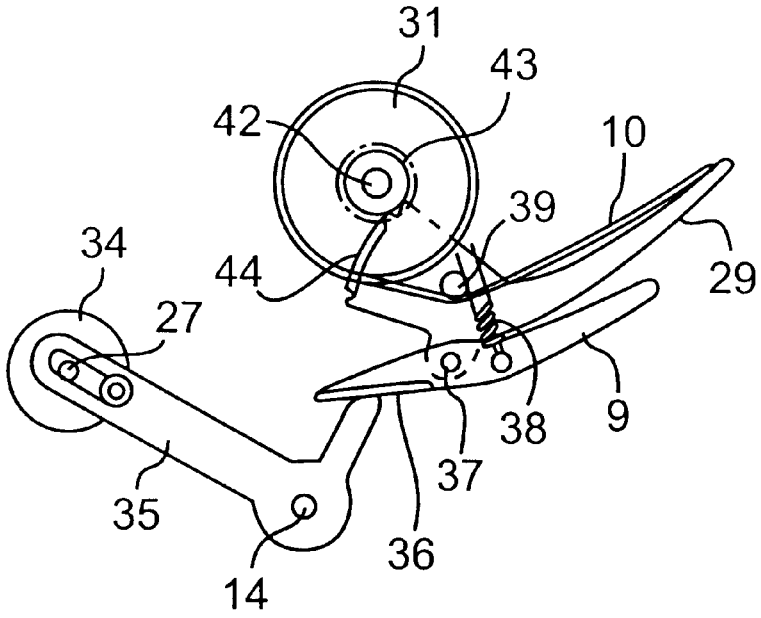
FIGS. 8*a* and 8*b* are views illustrating an operative state of an uvula of the present invention; and, FIGS. 9*a* and 9*b* are views illustrating an operative state of a lingua of the present invention.
Figure 8B:
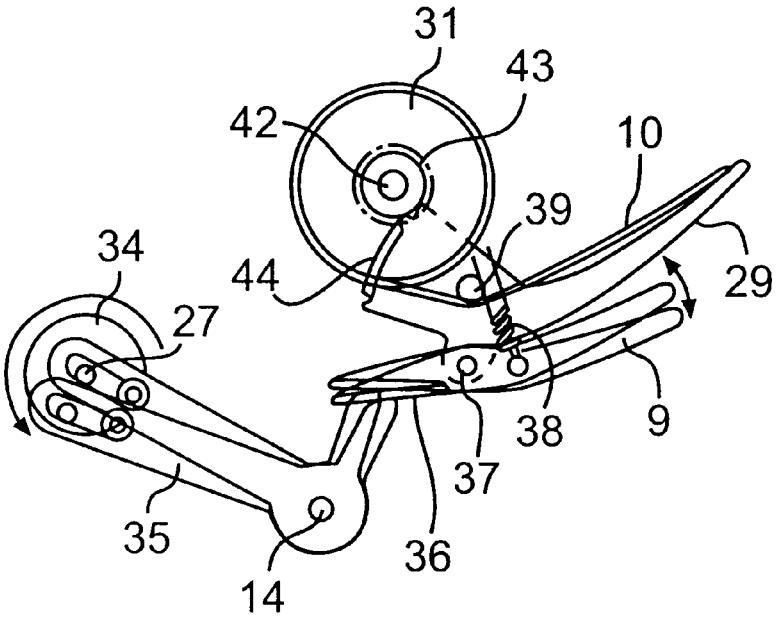
Figure 9A:
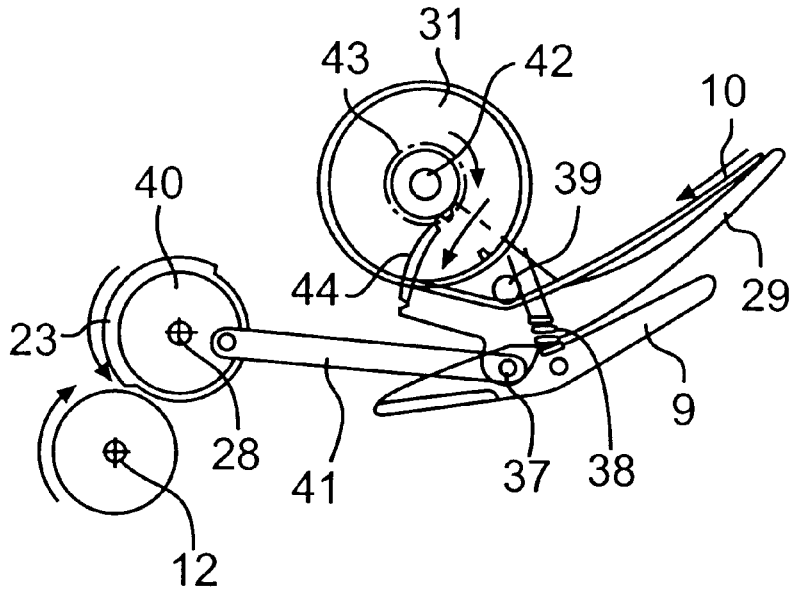
Figure 9B:
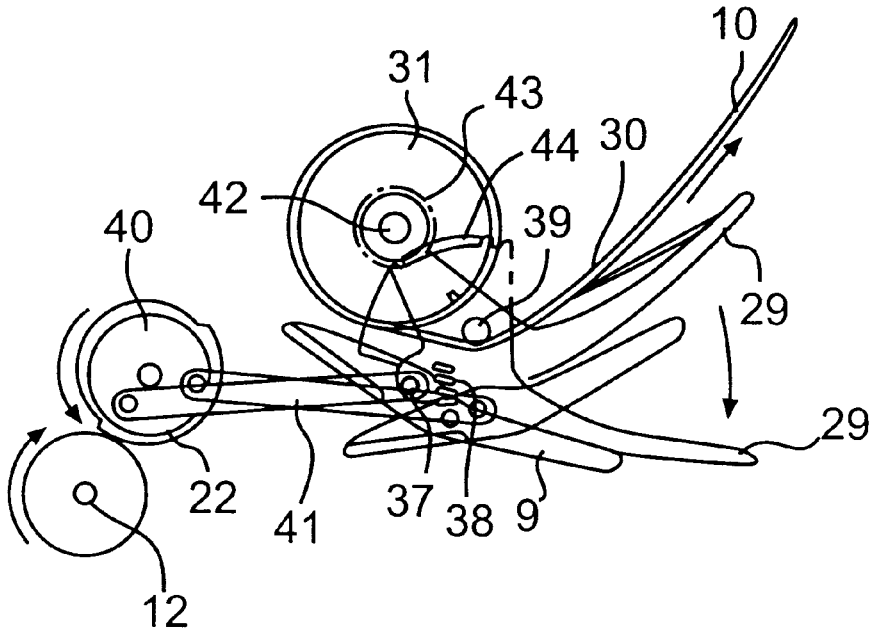

When the integral rod 18 of the clutch gear 12 is projected over the clutch operating cam 19 in a free state, the clutch gear 12 is geared to an uvula gear 20 for operating the uvula 9 as shown in FIG. 7*b*. When the integral rod 18 is pushed toward the spring 13 by a predetermined distance, the clutch gear 12 is geared to the electric drive gear 15 for operating the front legs 7 and the rear legs 8 as shown in FIG. 7*a*. When the integral rod 18 is pushed more to the gear box 3 so as to entirely compress the spring 13, the clutch gear 12 is geared to a lingua extension gear 22 and a lingua retracting gear 23 as shown in FIG. 7*c*. By virtue of the above, an uvula operating portion 24 a motion portion 25, and a lingua operating portion 26 are formed.

In the operation gear group 16, a sound producing gear 21 and the uvula gear 20 are connected on one side of a first rotary shaft 27. The lingua extension gear 22 and the lingua retracting gear 23 are connected on the other side of a second rotary shaft 28. Therefore, the gears 20 and 21 and the gears 22 and 23 rotate separately.

The lingua extension gear 22 has a toothed shape only in half of the lingua extension gear 22. Therefore, the clutch gear 12 connected to the lingua extension gear 22 is rotated in a 180 degree increment on the rotary shaft and is idly rotated in the other 180 degree. In case of lingua extension, a lower jaw 29 falls down and the lingua 10 is drawn out from a take up roller 31 and stuck out of the mouth for a while. The lingua retracting gear 23 also has a toothed shape only in half of the lingua retracting gear 23 at a opposite side of the toothed portion of the lingua extension gear 22. Therefore, when the clutch gear 12 is moved to the electric gear 15 by the clutch operating cam 19, the lower jaw 29 is moved in its original condition and the lingua 10 which is stuck out of the mouth during the rotation of the non-toothed portion of the lingua extension gear 22 is retracted into the mouth by the reverse rotation of the take up roller 31 due to the geared connection of the lingua retracting gear 23 and the clutch gear 12.

After retraction of the lingua 10, when the clutch gear 12 is geared to the electric drive gear 15 to rotate the electric drive gear 15, the lingua retracting gear 23 is continuously operated. Therefore, the lingua retracting gear 23 which has the toothed shape only on half of its periphery prevents the transmission of power and allows only the front legs 7 and the rear legs 8 to move.

A vibration member 32 is connected to the sound producing gear 21 of a sound case 33. When the sound producing gear 21 is rotated, the vibration member 32 connected to the sound producing gear 21 is vibrated. The vibration is transferred to the sound case 33 to produce the sound. The previously described sound producing gear 21, vibration member 32, and the sound case 33 are well known in the prior art.

The sound producing gear 21 and the uvula gear 20 are connected on the same rotary shaft 27, and a eccentric cam 34 is also connected on the first rotary shaft 27. A uvula crank 35 is connected to the eccentric cam 34 at an end of the uvula crank 35. The uvula crank 35 is idly connected on the crank shaft 14 on which the front legs 7 are mounted. When the uvula gear 20 is geared to the clutch gear 12 and rotated, the other end of the uvula crank 35 eccentrically connected to the eccentric cam 34 allows an uvula lever 36 of the uvula 9 mounted on the lower jaw 29 by a pin 37 to be moved.

The lower jaw 29 is mounted on the body 1 by a pin 39 to move angularly and the uvula 9 is mounted under the lower jaw 29 by a pin 37 to move angularly and formed integrally with the lower jaw 29. The uvula 9 is moved vertically around the pin 37 by the uvula lever 36 angularly moving vertically with the angular movement of the uvula crank 35. The uvula 9 has a spring 38 so that the uvula 9 is pulled upwardly from the underside of the lower jaw 29.

A eccentric cam 40 is connected on the other side of the first rotary shaft 27 on which the sound producing gear 21 and the uvula gear 20 is mounted. An end of an operation arm 41 is eccentrically connected to the eccentric cam 40. The other end of the operation arm 41 is connected on the pin 39 of the lower jaw 29. When the uvula gear 20 is geared to the clutch gear 12 and rotated, the operation arm 41 is moved straightly by the rotation of the eccentric cam 40 which is connected on the first rotary shaft 27 and the lower jaw 29 is downwardly moved around the pin 39 such that the lower jaw 29 can be moved downwardly.

In the state that the lower jaw 29 is angularly moved about the pin 39, the take up roller 31 for taking up a tongue member 10 having elasticity is connected by an idle pin 42. A gear 43 which is formed integrally with the take up roller 31 is geared to a gear 44 which is formed integrally with the lower jaw 29.

One end of the lingua 10 is fixed at the take up roller 31 and the other end of the lingua 10 is situated on the lower jaw 29. When the take up roller 31 is rotated, the tongue member 10 is stuck out of the mouth and raised upwardly by its elasticity. When the take up roller is reversely rotated, the tongue member 10 is put into the mouth in the same manner as for a real frog.

The reference numeral 30 indicates a tension member allowing the lingua 10 extended from the take up roller 31 to be pulled toward the take up roller 31 and be raised upwardly.

According to the present invention having simple construction and power transmission by the previously described apparatus, the movement of the front legs 7 and the rear legs 8, the sound production performed with the movement of the uvula 9, and the extension and retraction of the uvula 10 with the lower jaw 29 open are repeatedly performed, thereby the movable frog toy can perform the same motions as the real frog. The present invention functions as follows.

When turning on a switch, the operation gear 11 which moves with the transmission gear group 14 operatively connected to the motor 4 is operated, and the clutch gear 12 geared with the operation gear 11 is rotated.

As shown in FIG. 7*a*, when the integral rod 18 of the clutch gear 12 is contacted to the motion portion 25 of the clutch operating cam 19 and the clutch gear 12 is geared to the electric drive gear 15, the front legs 7 of the crank shaft 14 on which the electric drive gear 15 is connected are moved and the rear legs 8 connected with the front legs 7 by the lever 17 are also simultaneously moved, so that the frog toy can execute the same jumping motion as the real frog.

While moving the front legs 7 and the rear legs 8, when the clutch gear 12 and the clutch operating cam 19 are rotated and the integral rod 18 of the clutch gear 12 is located on the uvula operating portion 24 of the clutch operating cam 19, the integral rod 18 is moved outwardly by the elasticity of the spring 13 and the clutch gear 12 is geared to the uvula gear 20.

When the clutch gear 12 is geared to the uvula gear 20, the sound producing gear 21 is operatively connected to the uvula gear 20 on the first rotary shaft 27 so as to produce the frog sound through the sound case 33 connected to the sound producing gear 21 by the vibration member 32.

The uvula crank 35 which is eccentrically connected to the eccentric cam 34 of the first rotary shaft 27 by the rotation of the first rotary shaft 27 and which is idly connected to the crank shaft 14 is angularly moved by the rotation of the eccentric cam 34. The uvula lever 36 contacting to the other end of the uvula crank 35 is angularly moved so as to move upwardly and downwardly the uvula 9 connected to the lower jaw 29 by the pin 27.

At this time, the sound producing gear 21 is also rotated, and the sound production is performed simultaneously with the movement of the uvula. 9. The uvula 9 is operated according to the uvula lever 36 contacted with the uvula crank 35 and repeatedly lifted by the restorative force of the spring 38, thereby the movable frog toy can move the uvula 9 while producing the sound.

While moving the uvula 9, when the integral rod 18 is located on the lingua operating portion 26 of the clutch operating cam 19, the spring 13 is entirely compressed and the integral rod 18 is geared to the lingua extension gear 22. At this time, the eccentric cam 40 of the rotary 28 connected to the lingua extension gear 22 is rotated and the operation arm 41 is moved linearly. According to the above, the lower jaw 29 connected to the operation arm 41 is downwardly moved around the pin 39.

When the lower jaw 29 is downwardly moved, the gear 43 of the take up roller 31 contacted to an operation gear 44 of the lower jaw 29 is rotated and the take up roller 31 is also rotated, thereby the lingua 10 having the end portion fixed on the take up roller 31 is extended from the mouth while lifted upwardly.

In the state that the lingua 10 is extended, when the clutch operating cam 19 is rotated with the rotation of the clutch gear 12 and the integral rod 18 of the clutch gear 12 is located on the motion portion 25 of the clutch operating cam 19, the clutch gear 12 is geared to the electric gear 15 to perform the jumping motion of the front legs 7 and the rear legs 8 of the frog, and is simultaneously geared to the lingua retracting gear 23 such that the operation arm 41 connected on the eccentric cam 34 of the second rotary shaft 28 is again moved straightly to perform the up and down movement of the lower jaw 29. The take up roller 31 is reversely rotated such that the lingua extended out of the mouth is winded on the take up roller 31 so as to put it into the mouth.

The clutch gear 12 repeatedly performs the previously described motions, thereby the movable frog toy can perform the same motions as the real frog.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A movable frog toy comprising:

a body, front legs, rear legs, an uvula and a lingua, a drive motor connected to the body: and a plurality of transmission gear groups connected to the drive motor for operating the front legs and rear legs by actuation of a drive gear, wherein the movable frog toy further comprises:

a clutch gear connected to an operation gear of the transmission gear group, the clutch gear having a reciprocable shaft with one end elastically supported by a spring and the other end engageable with a clutch operating cam:

a motion portion formed on the clutch operating cam for engaging said other end of the shaft and compressing the spring a first distance, wherein the clutch gear is coupled to the drive gear for operating the front legs and the rear legs to transport the body of the frog toy;

an uvula operating portion formed on the clutch operating cam for engaging said other end of the shaft and compressing the spring a second distance, wherein the clutch gear is geared to an uvula gear for operating the uvula:

a lingua operating portion formed on the clutch operating cam for engaging said other end of the shaft and compressing the spring a third distance, wherein the clutch gear is geared to a lingua extension gear and a lingua retracting gear;

a first rotary shaft for mounting the uvula gear and a sound producing gear on the same axis;

an uvula crank eccentrically connected to an eccentric cam of the first rotary shaft, the uvula crank connected to a lower jaw of the uvula which is pivoted about a pin, the uvula crank being connected to an uvula lever having a spring for allowing the lower jaw of the uvula to be angularly moved around the pin;

a second rotary shaft for mounting the lingua extension gear and the lingua retracting gear on the same axis;

an operation arm eccentrically connected to an eccentric cam of the second rotary shaft, the operation arm connected to the lower jaw;

the lingua having an end fixed at a take up roller connected on the lower jaw by an idle pin, said lingua being elastically windable on the take up roller; and a contact gear formed integrally with the take up roller, the contact gear being geared with the uvula gear for moving the lower jaw whereby the transmission gear groups synchronize movement of the legs, uvula, lingua and sound generated by the frog to simulate the movements and sound of a real frog.

2. A movable frog toy comprising:

(a) a body simulating the appearance of a frog;

(b) a mouth defined by a pair of relatively movable jaws;

(c) a tongue movable out of or into the mouth;

(d) a pair of front legs;

(e) a pair of rear legs;

(f) a sound generator for simulating audible sounds of a frog;

(g) a drive motor for supplying power and movement to the above-mentioned parts (a) to (f) of the frog toy;

(h) a plurality of transmission gear groups for selectively coupling the drive motor to the parts (a) to (f) of the frog toy to execute synchronized operation of the said parts, a first of the gear groups simultaneously connecting the drive motor to the front and rear legs to provide a hopping movement to the frog toy, a second gear group for extending the tongue out of the mouth or retracting the tongue into the mouth; and a third gear group for simultaneously moving the jaws of the mouth and energizing the sound generator.

3. The movable frog toy of claim 2, further including a controller for selectively coupling the drive motor to said first, second, and third gear groups to synchronize the movements of said parts (a) to (f) to simulate the natural movements and sounds of a real frog.

4. The movable frog toy of claim 3, wherein the controller is a cam timer mechanism driven by the drive motor.

* * * * *